US006426768B1

(12) United States Patent
Kubelik

(10) Patent No.: US 6,426,768 B1
(45) Date of Patent: Jul. 30, 2002

(54) UNIVERSAL PRINTHEAD

(75) Inventor: Igor Kubelik, Mississauga (CA)

(73) Assignee: Xerox Corporation, Stamford, CT (US)

( * ) Notice: Subject to any disclaimer, the term of this patent is extended or adjusted under 35 U.S.C. 154(b) by 0 days.

(21) Appl. No.: 09/770,000

(22) Filed: Jan. 25, 2001

(51) Int. Cl.[7] ..... B41J 2/415
(52) U.S. Cl. ..... 347/123; 347/127
(58) Field of Search ..... 347/120, 123, 347/127, 128

(56) References Cited

U.S. PATENT DOCUMENTS 4,409,604 A * 10/1983 Fotland ..... 370/127
4,626,876 A * 12/1986 Miyagawa et al. ..... 347/104
4,891,656 A 1/1990 Kubelik ..... 346/155
5,159,358 A 10/1992 Kubelik ..... 346/159
5,202,705 A * 4/1993 Asano et al. ..... 347/127
6,081,286 A * 6/2000 Forland et al. ..... 347/128

* cited by examiner

*Primary Examiner*—Joan Pendegrass
(74) *Attorney, Agent, or Firm*—Fay, Sharpe, Fagan, Minnich & McKee, LLP

(57) ABSTRACT

A method and apparatus for a universal printhead is disclosed that functions independently of the diameter of a charge receiving dielectric drum, while optimizing print quality. The printhead includes two sets of electrodes mutually separated by a dielectric. Each of the electrodes from the first layer crosses each of the electrodes from the second layer forming a plurality of charge generating sites. The charge generating sites are generally disposed in only two rows.

15 Claims, 5 Drawing Sheets

UNIVERSAL PRINTHEAD

FIELD OF THE INVENTION

The invention relates to a printhead suitable for use with image forming systems, and more particularly relates to an arrangement of electrode and dielectric layers within a printhead for optimizing print quality and performance.

BACKGROUND OF THE INVENTION

There are many different printing technologies utilized today for creating and reproducing images in an image forming system. Several of these technologies include a general process of charging a surface of a latent image receiving member, such as a drum, with a latent charge image. The term drum illustrates a common structure for support of the latent image-receiving member. The drum can also be one of several other architectures including a curved latent image receiving member, or a flexible dielectric belt, which moves along a predetermined path. A drum can also be an imaging member, such as a liquid crystal, phosphor screen, or similar display panel in which the latent charge image results in a visible image. The drum typically includes on an exterior surface thereof, a material that lends itself to receiving the latent charge image, such as a dielectric layer. Accordingly, the term drum used herein shall mean all such structures or devices.

A number of organic and inorganic materials are suitable for the dielectric layer of the drum. The suitable materials include glass enamel, anodized, flame or plasma sprayed high-density aluminum oxide, and plastic, including polyamides, nylons, and other tough thermoplastic or thermoset resins, among other materials.

The drum rotates past an image-forming device, such as a printhead, which produces a stream of accelerated electrons as primary charge carriers. The electrons reach the drum, landing in the form of a latent charge image. The latent charge image then receives a developer material to develop the image. The image is applied to a medium, e.g., a sheet of paper, by press or electrostatic transfer to form a printed document.

The printhead is most often a multi-electrode structure that defines an array of charge generating sites. Each of the charge generating sites, when the electrodes are actuated, generates and directs toward the drum a stream of charge carriers, e.g., electrons, to form a pointwise accumulation of charge on the drum that constitutes the latent image. A representative printhead generally includes a first collection of drive electrodes, e.g., RF-line electrodes, oriented in a first direction across the printing direction. A second collection of control electrodes, e.g., finger electrodes, oriented transversely to the drive electrodes, forms cross points or intersections with the drive electrodes constituting an array of charge generating sites at which charges originate. A dielectric layer couples to, and physically and electrically separates and insulates, the RF-line electrodes from the finger electrodes.

The printhead can also include a third electrode structure, often identified as a screen electrode. This screen electrode couples to the finger electrodes by an insulating structure, such as a spacer layer. The screen electrodes have a plurality of passages aligned with the charge generating sites, to allow the stream of charge carriers to pass through. The screen electrode can be a single conductive sheet having an aperture aligned over each charge generating site. Polarity of charge carriers passing through the passages, or apertures, depends on the voltage difference applied to the finger and screen electrodes. Polarity of particles accumulated on the drum to create latent image is determined by the voltage difference between the screen electrode and the drum surface. The charged particles of appropriate polarity are inhibited from passing through the aperture, depending upon the sign of their charge, so that the printhead emits either positive or negative charge carriers, depending on its electrode operating potentials.

One issue associated with current printing technology is that there is a significant size variation in dots landing on the drum. For example, conventional printheads have typically from 12 to 20 RF-line electrodes. Charge carriers that are generated from the outermost RF-lines deposit on the cylindrical drum in the form of a dot that is relatively smaller than those dots resulting from charge carriers emitted from more centrally located RF-line electrodes. This is because of a difference in distance between the outermost RF-lines and the curved surface of the drum, and the innermost RF-lines and the curved surface of the drum. Charge carriers emitted from the outermost RF-lines travel in a weaker electric field and must overcome greater distance to reach the drum surface than charge carriers emitted from the innermost RF-lines. The variation in the travel conditions causes this anomaly. The minimum air gap, and therefore the maximum electric field in between the screen and the dielectric drum, is normally directly beneath the more central RF-line electrodes. With decreasing drum diameters, the variations become increasingly severe because the curvature of the drum surface increases.

To compensate for the dot size variations, some prior art solutions have included enlarging the charge emitting sites, i.e., screen holes, or increasing the number of cycles incorporated in a single RF burst. Such compensation methods are unique to a particular drum/printhead combination, and do not compensate for blooming effects.

Blooming is essentially spreading the charged particles around the targeted area. Such spreading is a result of repulsive electrostatic forces between arriving and already deposited charge particles. The level of blooming depends on a ratio of these repulsive forces and attractive forces created by the electric field in the printhead/drum region. The resulting blooming effect has a substantial impact on dot geometry.

The surface charging effect also slightly deflects dots, which are aimed nearby. If charge dot is to be deposited in the proximity of one or more charged dots that have already been laid down, the interaction between the particle beam and previously deposited charge results in the dot lateral shift. Because the printing order of dots is constant, similar conditions and dot quality repeat in each printed line. Therefore, all deviations are organized in the process direction, which reveals itself as streaks of different intensity of print. This effect is known as Venetian blinding.

Therefore, charge density profiles of the dot latent images still depend on the screen hole positions. Further, the respective differences vary with charge level. Such issues significantly deteriorate the print quality of the printhead for grayscale or color images.

SUMMARY OF THE INVENTION

For the foregoing reasons, there exists in the art a need for a universal printhead that functions independent of the diameter of the charge receiving dielectric drum, while concomitantly optimizing print quality and lessening the effects of blooming or Venetian blinding (print quality descriptors that are well known in the art). The present invention is directed toward further solutions in this art.

In accordance with one aspect of the present invention, a printhead is provided having a first layer of electrodes covered and sealed by a dielectric material. Further layered upon the dielectric material is a second layer of electrodes. Each of the electrodes from the first layer intersects with each of the electrodes from the second layer and forms a plurality of charge generating sites. The charge generating sites are generally disposed in only two rows.

In accordance with another aspect of the present invention, the first plurality of electrodes includes two elongate electrode RF-lines. The second plurality of electrodes includes a plurality of finger electrodes that are arranged in a plurality of rows. Each finger electrode is coupled to a separate contact pad.

In accordance with still another aspect of the present invention, the first plurality of electrodes includes two rows of RF-line electrodes that are broken into sections or segments. The second plurality of electrodes includes a plurality of finger electrodes that are arranged in a plurality of rows. There is a single contact pad coupled to each of a subset of the second plurality of electrodes.

In accordance with yet another aspect of the present invention, the first plurality of electrodes includes a plurality of collector electrodes that are coupled to relatively shorter segments of said plurality of finger electrodes. The second plurality of electrodes includes a plurality of finger electrodes. Pairs formed from the plurality of electrodes are coupled to a single contact pad.

BRIEF DESCRIPTION OF THE DRAWINGS

The aforementioned features and advantages, and other features and aspects of the present invention, will become better understood with regard to the following description and accompanying drawings, wherein.

DETAILED DESCRIPTION OF THE INVENTION

The present invention generally relates to a universal printhead mounted in an image forming system. A characteristic of the universal printhead is that there exists a two-row arrangement of all charge generating sites. These rows of charge generating sites are substantially parallel to a dielectric drum axis. This geometry provides for printhead adjustment where all screen holes are evenly spaced from the dielectric surface. Therefore, electric fields inside the printhead cavities, as well as in the space between the screen and the dielectric drum, are substantially the same and homogeneous charge emission exists over the entire printhead area. Such an arrangement significantly reduces Venetian blinding effect that commonly arise during printing uneven dots. The structure is independent of the surface curvature of the drum, and of the charging level.

Drawings, throughout FIGS. 1 through 5, illustrate an image forming system and several example embodiments of a universal print head employed in accordance with the teachings of the present invention. Although the present invention will be described with reference to the example embodiments illustrated in the figures, it should be understood that many alternative forms can embody present invention. One of ordinary skill in the art will additionally appreciate different ways to alter the parameters of the embodiments disclosed, such as the size, shape, or type of elements or materials, in a manner still in keeping with the spirit and scope of the present invention.

Further, the image forming system is illustrated solely to provide a general structure into which the present invention can fit. It is wholly anticipated that other systems or charge transfer apparati can be utilized in combination with different embodiments of the present invention.

Figure 1:
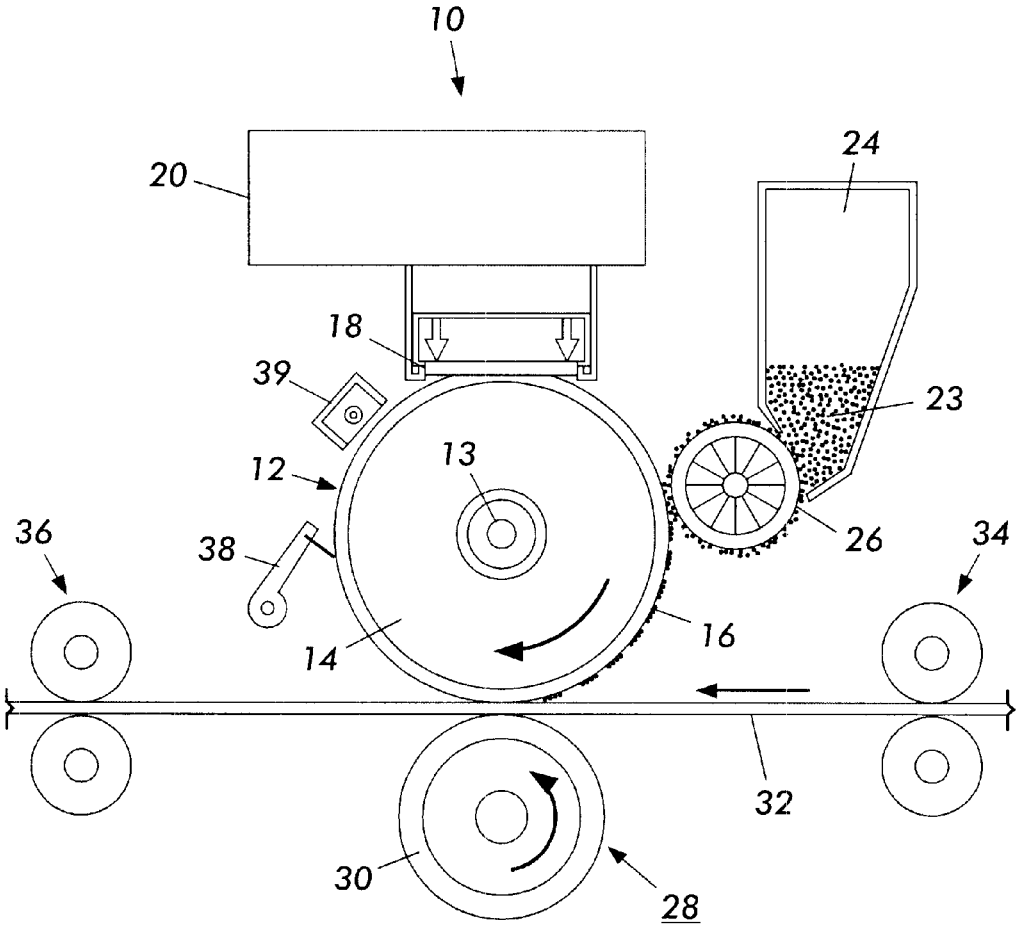
FIG. 1 is a diagrammatic illustration of an image forming system.

Describing an image forming system 10 in detail shown in FIG. 1, generally a drum 12 mounts for rotation about an axis 13. The drum 12 incorporates an electrically conductive core 14, coated with a dielectric layer 16. The dielectric layer 16 receives a charge image from a printhead 18. A controller 20 drives the print head 18 as desired. As the drum 12 rotates in the direction of the arrow shown, charge generating sites 66 (see FIG. 3) within the printhead 18 generate charges projected to the dielectric layer 16 on the outer surface of the drum 12. The drum 12 continues to rotate and the dielectric layer 16 becomes exposed to toner particles 23 supplied from a hopper 24 through a feeder 26. The toner particles 23 electrostatically adhere to the charged image on the dielectric layer 16 to form a toner image. The rotating drum 12 then carries the toner image towards a nip formed with a pressure roller 28. The pressure roller 28 has an outer layer 30 positioned in the path of a receptor, such as a paper sheet 32. The paper sheet 32 enters between a pair of feed rollers 34. The pressure in the nip is sufficient to cause transfer and affixation of the toner particles 23 to the paper sheet 32. The paper sheet 32 continues through and exits between a pair of output rollers 36. After passing through the nip between the drum 12 and the pressure roller 28, a scraper blade assembly 38 removes any toner particles 23 that may remain on the dielectric layer 16. An eraser 39 positioned between the scrapper blade assembly 38 and the printhead 18 removes any residual charge remaining on the dielectric layer 16 surface.

Figure 2:
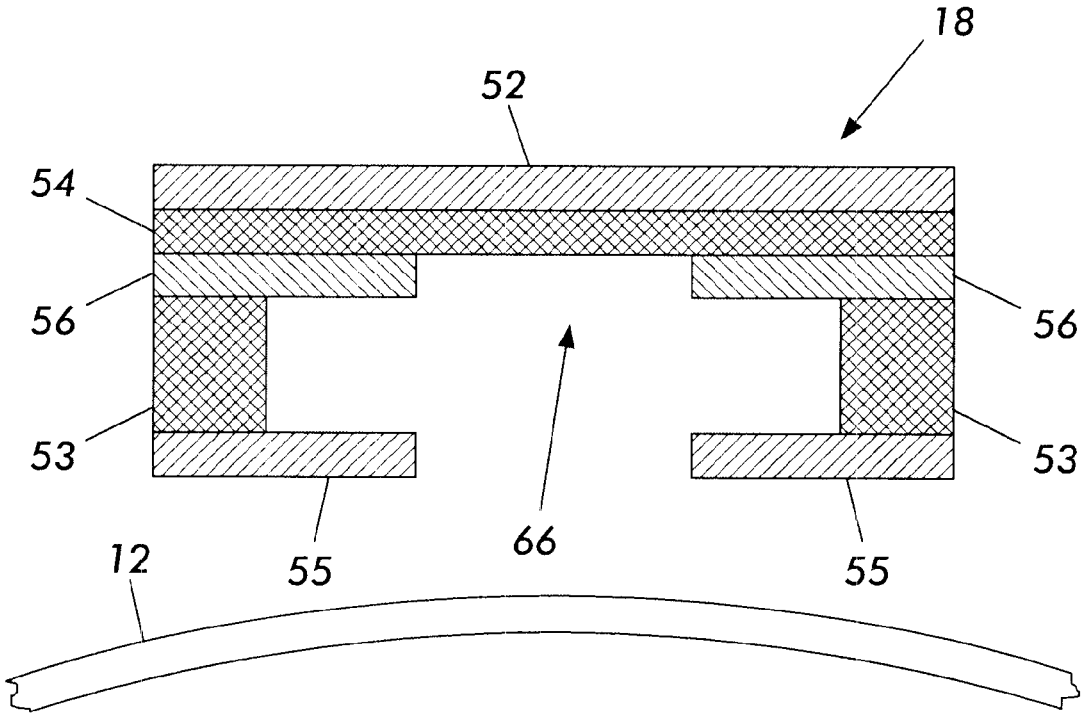
FIG. 2 is a diagrammatic cross section of a charge generating site in a printhead of the image forming system.

A portion of the printhead 18 (see FIG. 1) representing a single charge emitting site is illustrated in FIG. 2. The printhead 18 includes a layer of first electrodes, the RF-line electrodes 52, covered and sealed by a dielectric layer 54. On the opposite side of the dielectric 54 is disposed a second set of electrodes, the finger electrodes 56, according to one embodiment. The printhead 18 can also include a spacer layer 53 supporting a screen electrode 55. The screen electrode 55 aids in the proper alignment of the emitted charge carriers as is understood by one of ordinary skill in the art. The drum 12 is shown disposed below the printhead 18. It should be noted that the particular combination of electrodes as illustrated herein is merely one example embodiment of the present invention and additional combinations of layers, as understood by one of ordinary skill in the art, can be achieved.

Figure 3:
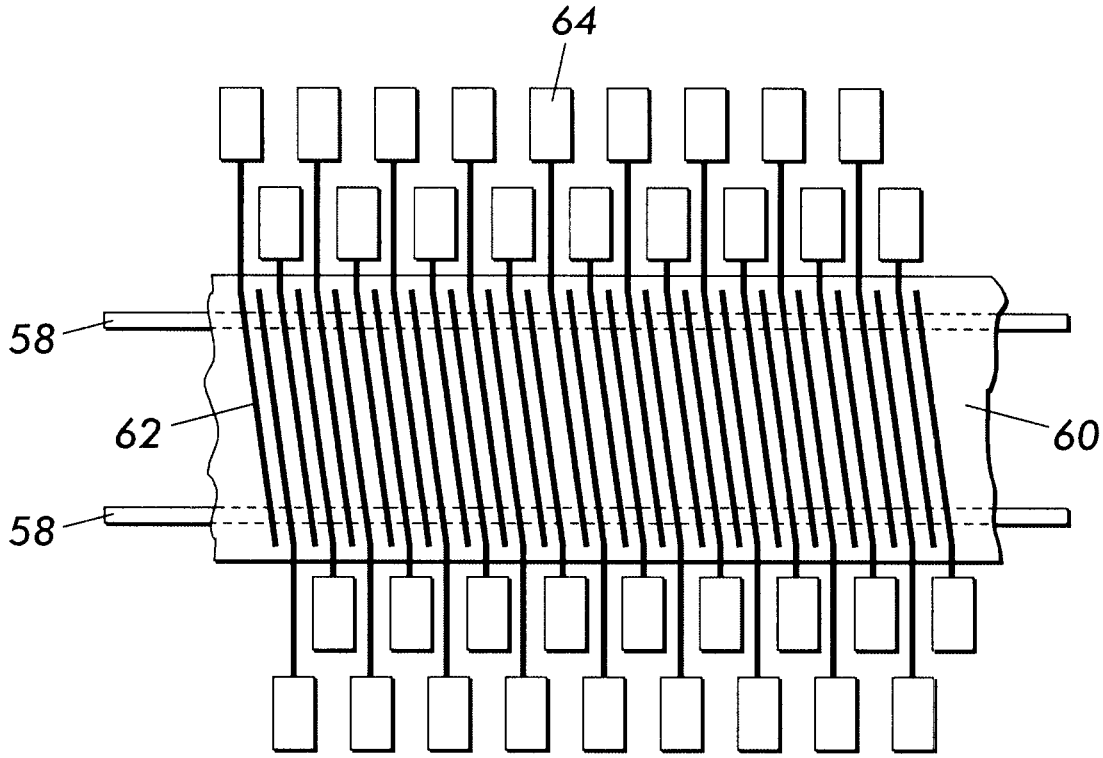
FIG. 3 is a schematic illustration of a collection of charge generating sites formed in the printhead of the present invention.

The general arrangement of the electrode layers that form a portion of the printhead 18 is described with reference to FIG. 3, which is a top view of the printhead 18 of FIG. 1. This illustration does not include any screen electrodes, or spacers supporting screen electrodes, in an effort to simplify the disclosure. RF-line electrodes 58 (positioned in a like manner to the first electrode layer 52 of FIG. 2, although this illustration shows the printhead 18 inverted) are provided underneath a dielectric layer 60 (similar to dielectric layer 54 of FIG. 2). The RF-line electrodes 58 terminate at portions (not shown) connected to contacts ultimately in communication with the controller 20. The RF-line electrodes 58 extend in a substantially parallel manner across a length of the dielectric layer 60. There is a substantially even separation distance between each of the two RF-line electrodes 58. The dielectric layer 60 covering the RF-line electrodes 58 can be made of any number of materials, such as most typically mica, Si-based polymers, silicon oxide, aluminum oxide, and the like. Layered atop the dielectric layer 60, and coupled thereto, is a layer of finger electrodes 62 (positioned in a like manner to the second electrode layer 56 of FIG. 2). Finger electrodes 62 terminate at finger contact pads 64, ultimately in communication with the controller 20. The finger electrodes 62 extend across the dielectric layer 60, and both of the RF-line electrodes 58. At locations where the finger electrodes 62 cross the RF-line electrodes 58, intersections form. These intersections form the charge generating sites 66, as shown in FIG. 2 required for the transmission of an electric charge image to the dielectric layer 16 of the drum 14 depicted in FIG. 1. These intersections are generally disposed in two rows.

In prior known arrangements for printhead configurations, there is most typically a plurality of intersections arranged in a plurality of rows or other array configurations. This leads to some potential issues with the charge generating sites being of unequal distances from the dielectric layer 16, upon which the charges are being projected, due to its curvature, as previously discussed. With arrangement of the charge generating sites 66 into only two rows, the distance between the charge generating sites and the dielectric layer 60 is uniform, no matter how distally the two rows are spaced. More specifically, the distance between the charge emitting sites 66 and the dielectric 16 is uniform regardless of the dielectric curvature.

Figure 4:
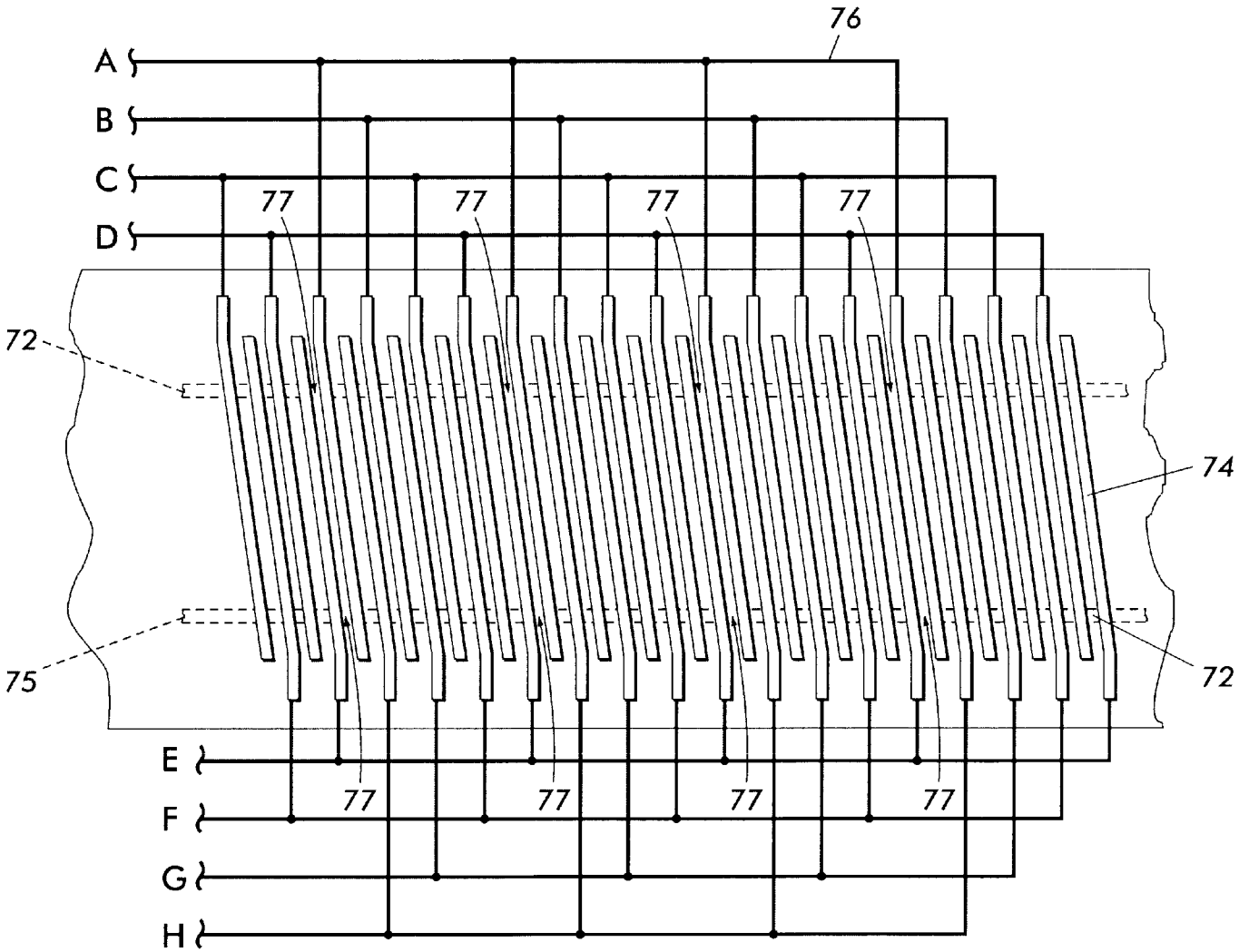
FIG. 4 is a schematic illustration of an alternate combination of charge generating sites formed in the printhead of the present invention.

In FIG. 4, an additional configuration is illustrated. In this configuration, RF-line electrodes 72 are segmented with provided spaces 77 between them. The segmentation of the RF-line electrodes 72 allows for the option of multiplexing the electrodes either by outside circuitry or by circuitry placed directly in the printhead 18. Covering the RF-line electrode 72 is again, a dielectric layer 75. Layered upon the dielectric layer 75 are finger electrodes 74. Corresponding to the RF-line electrode 72 segmentation, the finger electrodes are grouped into sections mutually interconnected with the finger collector lines 76. Each of the finger collector lines 76, representing many of finger electrodes, requires only a single contact pad to communicate with the controller 20. In the particular embodiment shown, there are eight finger electrodes 74 for each segment of RF-line electrodes 72. One finger electrode 74 of each segment 72 is connected together by a single collector line 76 (shown as A, B, C, D, E, F, G, and H). This results in each collector line 76 of lines A through H, having only a single finger electrode 74 crossing with each segment of RF-lines 72. Such arrangement allows for second level multiplexing of the charge emitting sites.

Furthermore, reduction in number of the contact pads eases manufacturing constraints typically associated with forming print heads for high density print, when a large number of pads needs to be placed into a relatively small space.

Figure 5:
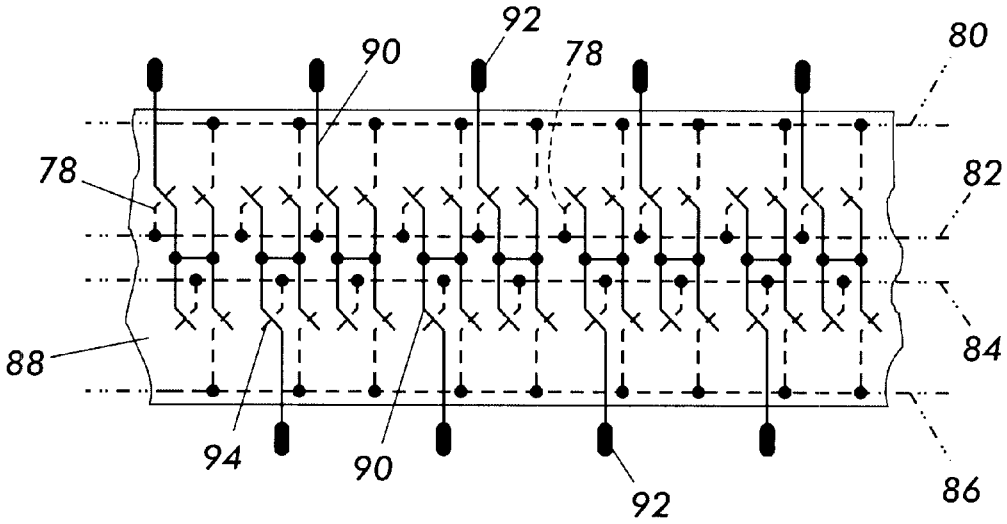
FIG. 5 is a schematic illustration of yet another alternate combination of charge generating sites formed in the printhead of the present invention.

Another embodiment of the present invention is illustrated in FIG. 5. In this particular aspect of the invention, the RF-lines are broken into small sections 78. Sets of RF-line electrode sections 78 are connected together by four collectors 80, 82, 84, and 86. Similar to structures shown in FIGS. 3 and 4, a dielectric layer 88 covers the RF-line sections 78. Layered upon the dielectric layer 88 is a collection of finger electrodes in the form of finger electrode pairs 90. The finger electrode pair 90 comprises a finger electrode that couples with a second finger electrode, and then couples with the contact pad 92. Thus, signals sent to each contact pad 92 further convey to both electrodes of each finger electrode pair 92. Each finger electrode pair 92 creates four intersections or charge generating sites 94 with four different RF-line electrode sections 78, one from each of the collectors 80, 82, 84, and 86.

Again, the arrangement of crossings of the RF-line electrode sections 78 with the finger electrode pairs 90 results in two rows of charge generating sites 94, in accordance with the aspects of the present invention. In this arrangement, the contact pads 92 can be ultimately placed on opposite sides of the printhead 18 to decrease their density.

It should be noted that the aforementioned configurations and embodiments are only examples of viable solutions. Advantages described herein apply for any kind of printhead where charge generating sites are organized into only two rows according to the present invention, regardless of the kind and shape of individual charge generators. The same principles are valid when considering modular printhead made from a series of small printhead modules. It should also be noted that similar results are attained with printheads where geometries of the finger electrodes are utilized for the RF-line electrodes and vice versa.

A significant advantage of the present invention is that in maintaining two rows of charge generating sites, the printhead 18 is not dependent on the shape of the image receiving dielectric layer 60. With additional rows of charge generating sites beyond two, the distances between those sites and the dielectric drum surface continuously increases. However, with only two rows of charge emitting loci, the corresponding distances to the dielectric drum surface are substantially the same, thereby drastically reducing the problems associated with dielectric drum curvature. This is why there is a substantial elimination of so-called Venetian blinding affect for all charging levels, and an equalization of the blooming effect for all charge generating sites.

Numerous modifications and alternative embodiments of the invention will be apparent to those skilled in the art in view of the foregoing description. Accordingly, this description is to be construed as illustrative only and for teaching those skilled in the art the best mode for carrying out the invention. Details of the structure may vary substantially without departing from the spirit of the invention, and exclusive use of all modifications that come within the scope of the appended claims is reserved. It is intended that the invention be limited only to the extent required by the appended claims and the applicable rules of law.

What is claimed is:

1. A printhead for use in an image forming system, comprising:

a first plurality of segmented electrodes coupled to a layer of dielectric material; and a second plurality of electrodes coupled to said dielectric material, wherein one or more of said first plurality of electrodes intersects one or more of said second plurality of electrodes to form a plurality of charge generating sites, said charge generating sites being generally arranged along only a pair of rows.

2. The printhead of claim 1, wherein said second plurality of electrodes comprises a plurality of finger electrodes arranged in a plurality of rows, each of said plurality of finger electrodes being coupled to a contact pad and disposed transverse to said plurality of RF-line electrodes.

3. The printhead of claim 1, wherein said second plurality of electrodes comprises a plurality of finger electrodes arranged into sub-sets, further comprising a contact pad coupled to at least one finger electrode from each of said sub-sets of said second plurality of electrodes, and said second plurality of electrodes disposed transverse to said first plurality of electrodes.

4. The printhead of claim 1, wherein said second plurality of electrodes comprises a plurality of finger electrodes, wherein a pair of finger electrodes from said plurality of finger is coupled to a contact pad.

5. The printhead of claim 4, wherein said second plurality of electrodes comprises a plurality of collector lines intersecting with said plurality of finger electrodes.

6. The printhead of claim 5, wherein said plurality of collector lines comprise a first plurality of electrode segments and a second plurality of electrode segments extending outwardly from said first plurality of electrode segments, said second plurality of electrode segments intersecting with said finger electrodes to form said charge generating sites.

7. The printhead of claim 1, wherein each of said pair of rows is substantially linear.

8. The printhead of claim 7, wherein said pair of rows is generally parallel relative to each other.

9. An image forming system, comprising:

an image forming device including a printhead, said printhead comprising:

a first plurality of electrodes having a generally planar disposition and being segmented;

a second plurality of electrodes having a generally planar disposition layered upon and oriented substantially parallel with said first plurality of electrodes and forming a plurality of charge generating sites with said first plurality of electrodes, said sites being generally disposed in two rows; and a layer of dielectric material separating said first plurality and said second plurality of electrodes.

10. The printhead of claim 9 wherein said first plurality of electrodes comprises two elongate electrodes.

11. The printhead of claim 10, wherein said second plurality of electrodes comprises a plurality of finger electrodes, each of said plurality of finger electrodes being coupled to a contact pad and disposed transverse to said first plurality of electrodes.

12. The printhead of claim 9, wherein said second plurality of electrodes comprises a plurality of finger electrodes arranged into sub-sets, further comprising a contact pad coupled to at least one finger electrode from each of said sub-sets of said second plurality of electrodes, said second plurality of electrodes disposed transverse to said first plurality of electrodes.

13. The printhead of claim 9, wherein said second plurality of electrodes comprises a plurality of finger electrodes, wherein a pair of finger electrodes from said plurality of finger is coupled to a contact pad.

14. The printhead of claim 13, wherein said first plurality of electrodes comprises a plurality of collector lines coupled to said plurality of finger electrodes.

15. The printhead of claim 14, wherein said plurality of collector lines comprise a first plurality of electrode segments and a second plurality of electrode segments extending outwardly from said first plurality of electrode segments said second of electrode segments intersecting with said finger electrodes to form said charge generation sites.

* * * * *